US010704232B2

(12) United States Patent
Fukuda et al.

(10) Patent No.: US 10,704,232 B2
(45) Date of Patent: Jul. 7, 2020

(54) HYDRAULIC SYSTEM FOR WORKING MACHINE

(71) Applicant: KUBOTA CORPORATION, Osaka (JP)

(72) Inventors: Yuji Fukuda, Osaka (JP); Keigo Honda, Osaka (JP); Hiroaki Nakagawa, Osaka (JP); Daisuke Sakurai, Osaka (JP); Toshiya Tani, Osaka (JP); Taisuke Shinohara, Osaka (JP); Yoshihiro Ebata, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 84 days.

(21) Appl. No.: 15/837,516

(22) Filed: Dec. 11, 2017

(65) Prior Publication Data

US 2018/0163375 A1 Jun. 14, 2018

(30) Foreign Application Priority Data

Dec. 14, 2016 (JP) ..... 2016-242299

(51) Int. Cl.
*F15B 21/0423* (2019.01)
*E02F 9/22* (2006.01)
(Continued)

(52) U.S. Cl.
CPC ..... *E02F 9/2289* (2013.01); *E02F 3/422* (2013.01); *E02F 9/2095* (2013.01); *E02F 9/226* (2013.01);
(Continued)

(58) Field of Classification Search
CPC ..... F15B 21/042; F15B 21/0423; F15B 2211/611; F15B 2211/62; E02F 3/422;
(Continued)

(56) References Cited

U.S. PATENT DOCUMENTS 3,035,414 A * 5/1962 Smith ..... B66D 1/08 60/456
3,646,596 A * 2/1972 Bauer ..... E02F 9/22 60/486

(Continued)

FOREIGN PATENT DOCUMENTS

JP S60126553 U 8/1985
JP 2013-036274 2/2013

*Primary Examiner* — Michael Leslie
(74) *Attorney, Agent, or Firm* — Greenblum & Bernstein, P.L.C.

(57) ABSTRACT

A hydraulic system for a working machine includes an fluid cooler including an input port and an output port, the fluid cooler being configured to cool an operation fluid, an outputting portion to output the operation fluid, a traveling hydraulic device to be activated by the operation fluid, an operating hydraulic device to be activated by the operation fluid, a first output fluid tube connecting the operating hydraulic device to a tank, a second output fluid tube branching from the first output fluid tube and being connected to the input port of the fluid cooler, a third output fluid tube connecting the outputting portion to the output port of the fluid cooler, a fourth output fluid tube connected to the traveling hydraulic device, the fourth output fluid tube being connected to the second output fluid tube, and a first check valve disposed on the fourth output fluid tube.

11 Claims, 10 Drawing Sheets

(51) Int. Cl.

| | |
|---|---|
| ***E02F 3/42*** | (2006.01) |
| ***F15B 21/042*** | (2019.01) |
| ***F15B 13/02*** | (2006.01) |
| ***E02F 9/20*** | (2006.01) |
| *E02F 3/34* | (2006.01) |
| *E02F 3/36* | (2006.01) |

(52) U.S. Cl.
CPC ..... *E02F 9/2292* (2013.01); *E02F 9/2296* (2013.01); *F15B 13/027* (2013.01); *F15B 21/042* (2013.01); *F15B 21/0423* (2019.01); *E02F 3/3414* (2013.01); *E02F 3/369* (2013.01); *E02F 9/2267* (2013.01); *F15B 13/024* (2013.01); *F15B 2211/20538* (2013.01); *F15B 2211/20546* (2013.01); *F15B 2211/20576* (2013.01); *F15B 2211/30505* (2013.01); *F15B 2211/3111* (2013.01); *F15B 2211/3116* (2013.01); *F15B 2211/45* (2013.01); *F15B 2211/611* (2013.01); *F15B 2211/62* (2013.01); *F15B 2211/7135* (2013.01); *F15B 2211/7142* (2013.01)

(58) Field of Classification Search
CPC ..... E02F 9/2267; E02F 9/2289; E02F 9/2292; E02F 9/2296
USPC ..... 60/456
See application file for complete search history.

(56) References Cited

U.S. PATENT DOCUMENTS

| | | | | |
|---|---|---|---|---|
| 3,962,870 | A * | 6/1976 | Lech | E02F 9/2292 60/456 |
| 4,321,793 | A * | 3/1982 | Uranaka | E02F 9/2292 60/456 |
| 6,354,089 | B1 * | 3/2002 | Lech | F15B 21/042 62/50.2 |
| 9,228,599 | B2 * | 1/2016 | Son | F15B 21/042 |
| 2017/0292540 | A1 * | 10/2017 | Fukuda | F15B 21/042 |

* cited by examiner

HYDRAULIC SYSTEM FOR WORKING MACHINE

CROSS-REFERENCE TO RELATED APPLICATIONS

The present application claims priority under 35 U.S.C. § 119 to Japanese Patent Application No. 2016-242299, filed Dec. 14, 2016. The content of this application is incorporated herein by reference in their entirety.

BACKGROUND OF THE INVENTION

Field of the Invention

The present invention relates to a hydraulic system for a working machine such as a skid steer loader, a compact track loader, and the like.

Discussion of the Background

Japanese Unexamined Patent Application Publication No. 2013-36274 previously discloses a working machine such as a skid steer loader, a compact track loader, and the like to which an auxiliary attachment is attached.

The working machine disclosed in Japanese Unexamined Patent Application Publication No. 2013-36274 includes a control valve configured to control a hydraulic actuator of the auxiliary attachment, and a joint is connected to the control valve by a fluid tube. The joint is capable of connecting to a hydraulic hose of the hydraulic actuator, and thereby the control valve is actuated to operate the hydraulic actuator.

SUMMARY OF THE INVENTION

A hydraulic system for a working machine of the present invention, includes an fluid cooler including an input port and an output port, the fluid cooler being configured to cool an operation fluid, an outputting portion to output the operation fluid, a traveling hydraulic device to be activated by the operation fluid, an operating hydraulic device to be activated by the operation fluid, a first output fluid tube connecting the operating hydraulic device to a tank, a second output fluid tube branching from the first output fluid tube and being connected to the input port of the fluid cooler, a third output fluid tube connecting the outputting portion to the output port of the fluid cooler, a fourth output fluid tube connected to the traveling hydraulic device, the fourth output fluid tube being connected to the second output fluid tube, and a first check valve disposed on the fourth output fluid tube, the first check valve being configured to allow the operation fluid to flow toward the fluid cooler and to block the operation fluid not to flow toward the fluid cooler.

Another hydraulic system for a working machine of the present invention, includes an fluid cooler to cool an operation fluid, an outputting portion to output the operation fluid, a traveling hydraulic device to be activated by the operation fluid, an operating hydraulic device including a first output port and a second output port, a first output fluid tube connecting the outputting portion to the first output port of the operating hydraulic device, a sixth output fluid tube connected to the second output port of the operating hydraulic device and to the fluid cooler, a third output fluid tube connecting the outputting portion to the fluid cooler, a seventh output fluid tube connected to the traveling hydraulic device, the seventh output fluid tube being connected to the sixth output fluid tube, a fifth check valve disposed on the seventh output fluid tube, the fifth check valve being configured to allow the operation fluid to flow toward the fluid cooler and to block the operation fluid not to flow toward the traveling hydraulic device, an eighth output fluid tube connected to the outputting portion, the eighth output fluid tube being connected to the seventh output fluid tube, and a sixth check valve including a receiving portion to receive a pressure of the operation fluid of the sixth output fluid tube. The sixth check valve is configured to allow the operation fluid in the eighth output fluid tube to be outputted when the pressure of the operation fluid applied to the receiving portion is a predetermined pressure or more and to block the operation fluid in the eighth output fluid tube not to be outputted when the pressure of the operation fluid is not applied to the receiving portion.

Further another hydraulic system for a working machine of the present invention, includes an fluid cooler to cool an operation fluid, an outputting portion to output the operation fluid, a traveling hydraulic device to be activated by the operation fluid, an operating hydraulic device including a first output port and a second output port, the first output port and the second output port each being configured to output the operation fluid, a first output fluid tube connecting the outputting portion to the first output port of the operating hydraulic device, a sixth output fluid tube connected to the second output port of the operating hydraulic device and to the fluid cooler, a third output fluid tube connecting the outputting portion to the fluid cooler, a seventh output fluid tube connected to the traveling hydraulic device, the seventh output fluid tube being connected to the sixth output fluid tube, a fifth check valve disposed on the seventh output fluid tube, the fifth check valve being configured to allow the operation fluid to flow toward the fluid cooler and to block the operation fluid not to flow toward the traveling hydraulic device, an eighth output fluid tube connected to the outputting portion, the eighth output fluid tube being connected to the seventh output fluid tube, and a seventh check valve including a receiving portion to receive a pressure of the operation fluid of the first output fluid tube. The seventh check valve being configured to allow the operation fluid in the eighth output fluid tube to be outputted when the pressure of the operation fluid applied to the receiving portion is a predetermined pressure or more and to block the operation fluid in the eighth output fluid tube not to be outputted when the pressure of the operation fluid is not applied to the receiving portion.

Further another hydraulic system for a working machine of the present invention, includes an fluid cooler to cool an operation fluid, an outputting portion to output the operation fluid, a hydraulic pump to output the operation fluid, a plurality of hydraulic devices activated by the operation fluid, a plurality of control valves to control the plurality of hydraulic devices, a supplying fluid tube connected to the hydraulic pump, the supplying fluid tube being configured to supply the operation fluid to the plurality of control valves, a first output fluid tube connecting the supplying fluid tube to the outputting portion, a ninth output fluid tube connected to the supplying fluid tube and connected to the fluid cooler, and a main relief valve disposed on the ninth output fluid tube.

Further another hydraulic system for a working machine of the present invention, includes an fluid cooler to cool an operation fluid, an outputting portion to output the operation fluid, a traveling hydraulic device to be activated by the operation fluid, an operating hydraulic device including a first output port and a second output port, a first output fluid tube connecting the outputting portion to the first output port of the operating hydraulic device, a sixth output fluid tube connected to the second output port of the operating hydraulic device and to the fluid cooler, a tenth output fluid tube connected to the traveling hydraulic device, the tenth output fluid tube being connected to the sixth output fluid tube, a third output fluid tube connecting the outputting portion to the fluid cooler, a ninth check valve disposed on the tenth output fluid tube, the ninth check valve being configured to allow the operation fluid to flow toward the fluid cooler and to block the operation fluid not to flow toward the tenth output fluid tube.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
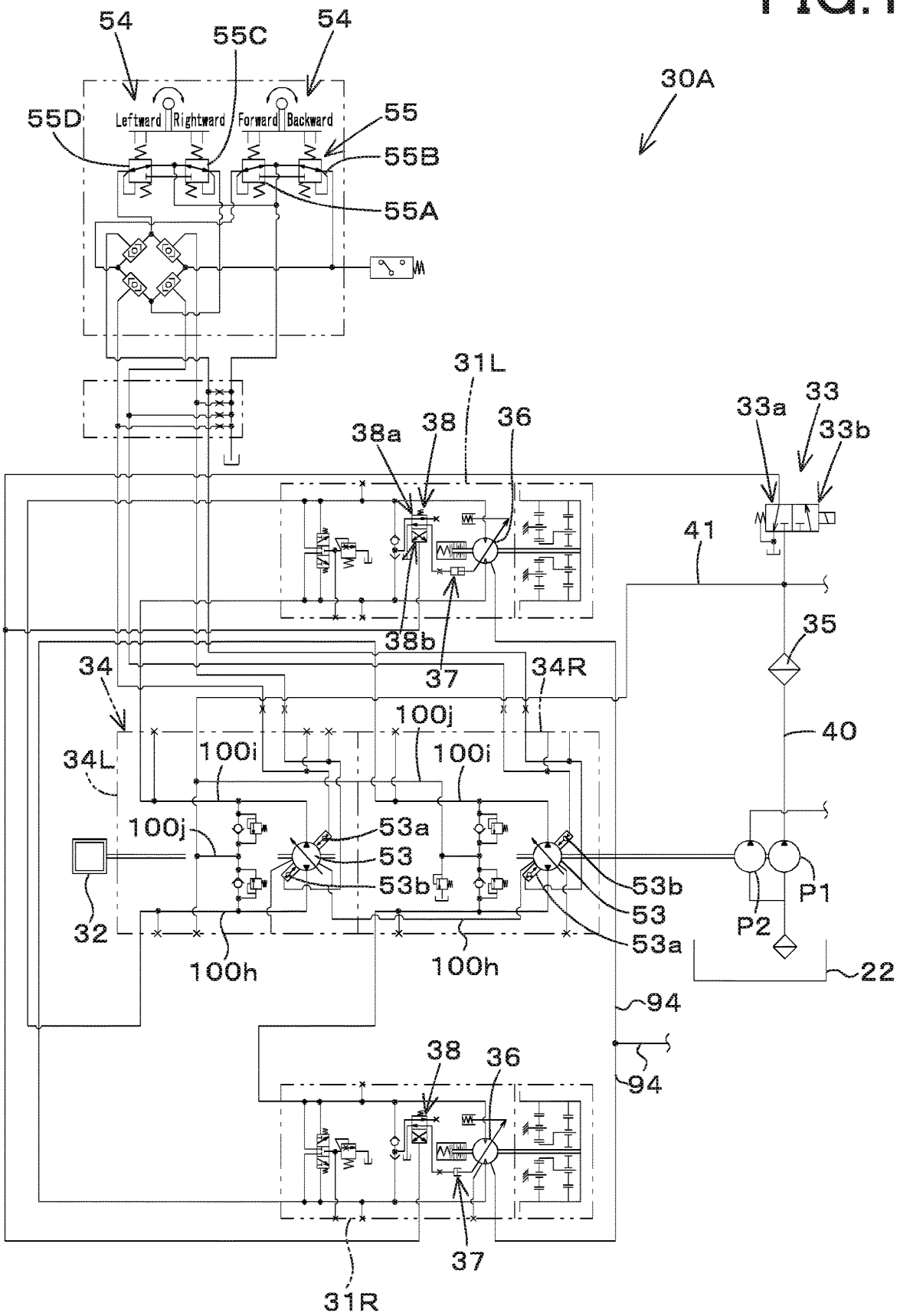
FIG. 1 is a schematic view illustrating a traveling hydraulic system according to a first embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Referring to drawings, the embodiments of the present invention, a hydraulic system for a working machine and the working machine having the hydraulic system, will be described below.

First Embodiment

Figure 7:
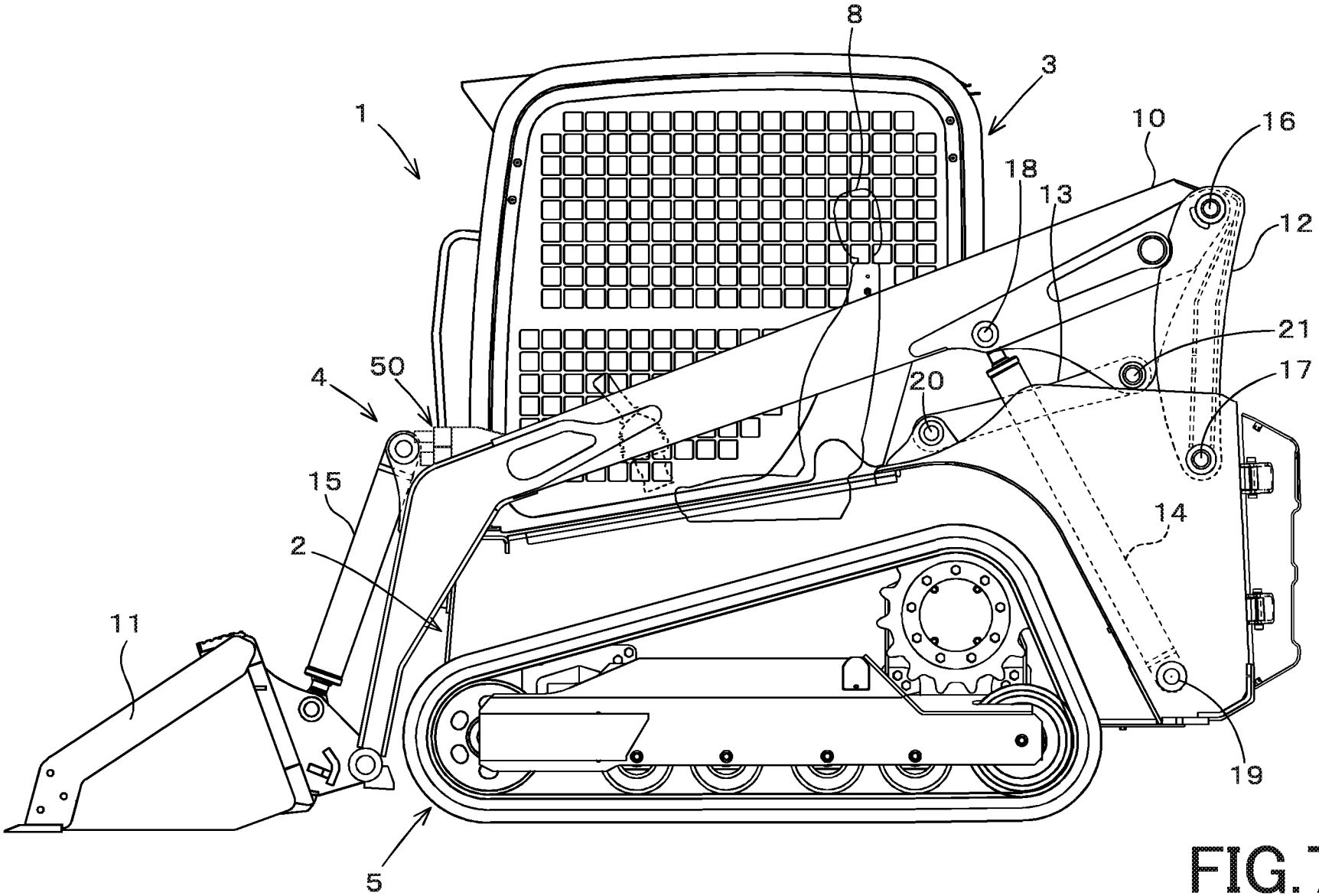
FIG. 7 is a side view illustrating a track loader that is one example of the working machine according to the embodiments of the present invention.
Figure 8:
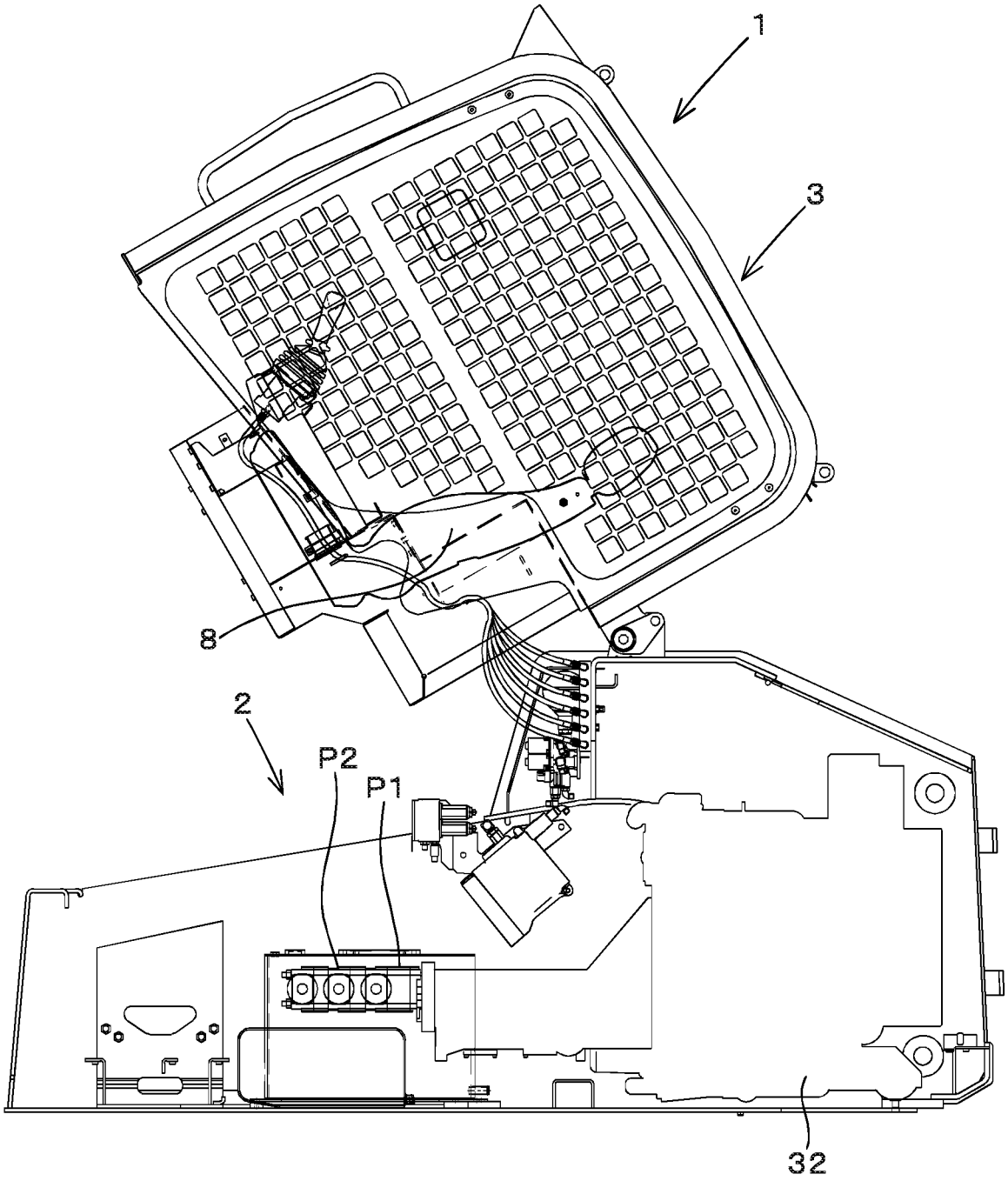
FIG. 8 is a side view illustrating a part of the track loader lifting up a cabin according to the embodiments.

A whole configuration of a working machine 1 according to a first embodiment of the present invention will be explained. As shown in FIG. 7 and FIG. 8, the working machine 1 includes a machine body 2, a cabin 3, an operating device 4, and a traveling device 5. FIG. 7 and FIG. 8 illustrate a Compact Track Loader (CTL) as an example of the working machine 1 according to the embodiments of the present invention. However, the working machine according to the embodiments of the present invention is not limited to the Compact Track Loader (CTL), and may be other types of the working machine, for example, a Tractor, a Skid Steer Loader (SSL), a Backhoe, and the like.

Hereinafter, in explanations of all the embodiments of the present invention, a forward direction (a left side in FIG. 7) corresponds to a front side of an operator seated on an operator seat 8 of the working machine 1, a backward direction (a right side in FIG. 7) corresponds to a back side of the operator, a leftward direction (a front surface side of the sheet of FIG. 7) corresponds to a left side of the operator, and a rightward direction (a back surface side of the sheet of FIG. 7) corresponds to a right side of the operator.

The cabin 3 is mounted on the machine body 2. The operator seat 8 is disposed in the cabin 3. The operating device 4 is attached to the machine body 2. The traveling device 5 is disposed on an outside of the machine body 2. A prime mover (an engine or an electric motor) is mounted on a rear portion of the machine body 2 internally.

The operation device 4 includes booms 10, a working tool 11, lift links 12, control links 13, boom cylinders 14, and bucket cylinders 15.

The operation device 4 includes two booms 10; one of the booms 10 is provided on a right side of the cabin 3 (referred to as the right boom 10) and is capable of freely swinging upward and downward, and the other one of the booms 10 is provided on a left side of the cabin 3 (referred to as the left boom 10) and is capable of freely swinging upward and downward. The working tool 11 is a bucket (hereinafter referred to as a bucket 11), for example. The bucket 11 is disposed on tip portions (front end portions) of the booms 10 and is capable of being freely swung upward and downward. The lift link 12 and the control link 13 support a base portion (a rear portion) of the boom 10 such that the boom 10 is capable of being freely swung upward and downward. The boom cylinder 14 is capable of being stretched and shortened to move the boom 10 upward and downward. The bucket cylinder 15 is capable of being stretched and shortened to swing the bucket 11.

The operation device 4 includes a joint pipe having a deformed shape, that is, the joint pipe being a deformed pipe. The joint pipe is connected to a front portion of the right boom 10 and to a front portion of the left boom 10 between the right boom 10 and the left boom 10, thereby jointing the right boom 10 and the left boom 10 each other. The operation device 4 also includes another joint pipe having a cylindrical shape, that is, the joint pipe being a cylindrical pipe. The joint pipe is connected to a base portion (a rear portion) of the right boom 10 and to a base portion (a rear portion) of the left boom 10 between the right boom 10 and the left boom 10, thereby jointing the right boom 10 and the left boom 10 each other.

The operation device 4 includes two lift links 12, two control links 13, and two boom cylinders 14. One of the lift links 12 (the right lift link 12), one of the control links 13 (the right control link 13), and one of the boom cylinders 14 (the right boom cylinder 14) are disposed on a right side of the machine body 2, corresponding to the right boom 10. And, the other one of the lift links 12 (the left lift link 12), the other one of the control links 13 (the left control link 13), and the other one of the boom cylinders 14 (the left boom cylinder 14) are disposed on a left side of the machine body 2, corresponding to the left boom 10.

The lift link 12 is vertically disposed on a rear portion of the base portion of the boom 10. The lift link 12 is pivotally supported at an upper portion (one end side) of the lift link 12 by a pivot shaft 16 (a first pivot shaft) to be capable of freely turning about a horizontal axis of the pivot shaft 16, the lift link 12 being supported to be close to the rear portion of the base portion of the boom 10 by the pivot shaft 16. In addition, the lift link 12 is pivotally supported at a lower portion (the other end side) of the lift link 12 by a pivot shaft 17 (a second pivot shaft) to be capable of freely turning about a horizontal axis of the pivot shaft 17, the lift link 12 being supported to be close to the rear portion of the machine body 2 by the pivot shaft 17. The second pivot shaft 17 is disposed lower than the first pivot shaft 16.

The boom cylinder 14 is pivotally supported at an upper portion of the boom cylinder 14 by a pivot shaft 18 (a third pivot shaft) to be capable of freely turning about a horizontal axis of the pivot shaft 18. The third pivot shaft 18 is disposed on the base portion of each of the booms 10, that is, on a front portion of the base portion. The boom cylinder 14 is pivotally supported at a lower portion of the boom cylinder 14 by a pivot shaft 19 (a fourth pivot shaft) to be capable of freely turning about a horizontal axis of the pivot shaft 19. The fourth pivot shaft 19 is disposed on a portion close to a lower portion of the rear portion of the machine body 2, and is disposed below the third pivotal shaft 18.

The control link 13 is disposed in front of the lift link 12, that is disposed forward from the lift link 12. One end of the control link 13 is pivotally supported by a pivot shaft 20 (a fifth pivot shaft) to be capable of freely turning about a horizontal axis of the pivot shaft 20. The fifth pivot shaft 20 is disposed forward from the lift link 12 on the machine body 2 at a position corresponding to the lift link 12.

The other end of the control link 13 is pivotally supported by a pivot shaft 21 (a sixth pivot shaft) to be capable of freely turning about a horizontal axis of the pivot shaft 21. The sixth pivot shaft 21 is disposed on the boom 10 in front of the second pivot shaft 17, that is, disposed forward from the second pivot shaft 17, and is disposed above the second pivot shaft 17.

Stretching and shortening of the boom cylinder 14 swing the boom 10 upward and downward about the first pivot shafts 16, the boom 10 being supported on the base portion of the boom 10 by the lift link 12 and the control link 13, thereby moving a tip portion of each of the booms 10 upward and down ward.

The control link 13 is swung upward and downward about the fifth pivot shaft 20 by the upward swinging and downward swinging of each of the booms 10. The lift link 12 is swung forward and backward about the second pivot shaft 17 by the upward swinging and downward swinging of the control link 13.

Not only the bucket 11, other working tools can be attached to the front portion of the boom 10. The following attachments (spare attachments) are exemplified as the other working tools; for example, a hydraulic crusher, a hydraulic breaker, an angle broom, an earth auger, a pallet fork, a sweeper, a mower, a snow blower, and the like. A connecting member 50 (also referred to as a connector 50) is disposed on the front portion of the boom 10 disposed to the left.

The connecting member 50 is a device configured to connect the hydraulic device installed on the auxiliary attachment to a first tubular member such as a pipe disposed on the boom 10. In particular, the first tubular member is configured to be connected to one end of the connecting member 50, and a second tubular member connected to the hydraulic device of the auxiliary attachment is configured to be connected to the other end of the connecting member 50. In this manner, the hydraulic operation fluid flowing in the first tubular member passes through the second tubular member, and is supplied to the hydraulic device.

The bucket cylinder 15 is arranged to be close to the front portion of each of the booms 10. The bucket 11 is swung by the stretching and shortening of the bucket cylinder 15. In the embodiment, each of the right travel device 5 and the left travel device 5 employs a crawler travel device (including a semi-crawler travel device). However, a wheeled travel device having a front wheel and a rear wheel may be employed as each of the right travel device 5 and the left travel device 5.

Next, a concrete configuration of the hydraulic system according to the embodiment of the present invention will be described below.

Figure 2:
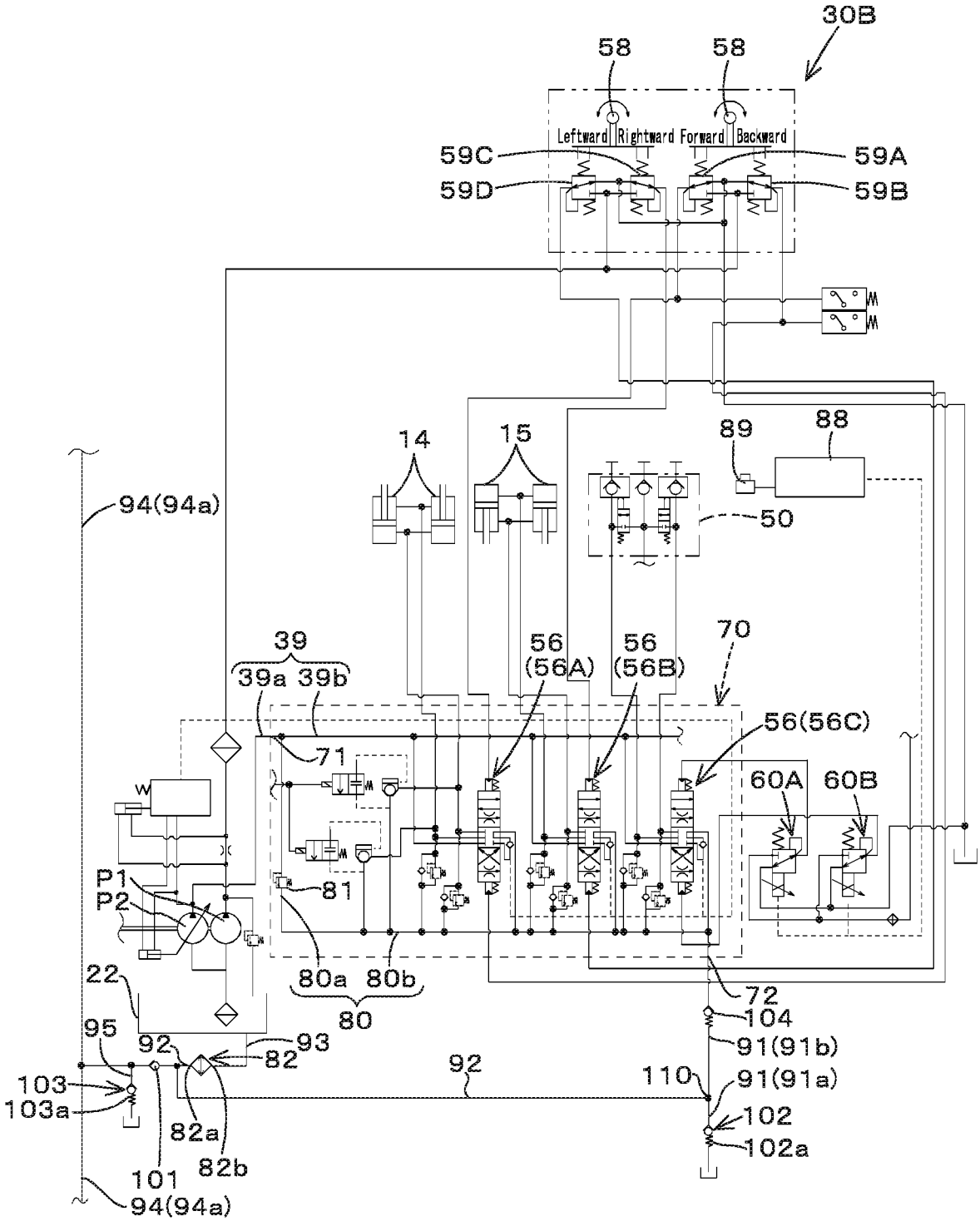
FIG. 2 is a schematic view illustrating an operating hydraulic system according to the first embodiment.

As shown in FIG. 1 and FIG. 2, the hydraulic system is roughly separated into a traveling hydraulic system 30A and an operating hydraulic system 30B.

The traveling hydraulic system 30A will be described below.

As shown in FIG. 1, the traveling hydraulic system 30A is a system

As shown in FIG. 1, the traveling hydraulic system 30A is a system configured to mainly drive a left traveling motor 31L and a right traveling motor 31R. The traveling hydraulic system 30A includes a prime mover 32, a direction switching valve 33, a first hydraulic pump P1, a first traveling motor 31L, a second traveling motor 31R, and a hydraulic drive device 34.

The prime mover 32 is constituted of an electric motor, an engine, and/or the like. The first hydraulic pump P1 is a pump configured to be driven by the power of the prime mover 32, and is constituted of a constant displacement type gear pump.

The first hydraulic pump P1 is configured to output the hydraulic operation oil stored in a tank 22. In particular, the first hydraulic pump P1 outputs the hydraulic operation fluid mainly used for the control. For convenience of explanation, the tank 22 storing the hydraulic operation fluid is referred to as a hydraulic fluid tank (or a hydraulic oil tank).

In addition, of the hydraulic operation fluid outputted from the first hydraulic pump P1, the hydraulic operation fluid used for the control may be referred to as a pilot fluid (or a pilot oil), and the pressure of the pilot fluid may be referred to as a pilot pressure.

An output fluid tube (also referred to as an outputting fluid passage) 40 through which the hydraulic fluid (the pilot fluid) flows is provided on the outputting side of the first hydraulic pump P1. The outputting oil passage 40 includes a filter 35, a direction switching valve 33, a first traveling motor 31L, and a second traveling motor 31R in turn. A first charging fluid tube (also referred to as a first charging fluid passage) 41 branching from the output fluid tube 40 is provided between the filter 35 and the direction switching valve 33. The first charging fluid tube 41 reaches the hydraulic drive device 34.

The direction switching valve 33 is constituted of a solenoid valve configured to change the rotational directions of the first traveling motor 31L and the second traveling motor 31R, that is, is constituted of a two-position switching valve configured to be switched between a first position 33*a* and a second position 33*b* by the magnetic excitation.

Switching operation of the direction switching valve 33 is performed by a switch or the like (not shown in the drawings).

The first traveling motor 31 L is constituted of a motor configured to transmit power to a drive shaft of the traveling device 5 that is disposed on the left side of the machine body 2. The second traveling motor 31R is a motor configured to transmit power to a drive shaft of the traveling device 5 disposed on the right side of the machine body 2.

The first traveling motor 31L includes an HST motor (traveling motor) 36, a swash plate switching cylinder 37, and a hydraulic switching valve 38. The HST motor 36 is constituted of a swash-plate type variable capacity axial motor, that is, is constituted of a motor configured to change the vehicle speed (rotations) to a first speed or a second speed.

The swash plate switching cylinder 37 is constituted of a cylinder configured to be stretched and shortened to change the angle of the swash plate of the HST motor 36. The hydraulic switching valve 38 is constituted of a valve configured to stretch and shorten the swash plate switching cylinder 37 to one side or the other side, that is, is constituted of a two-position switching valve configured to be switched to the first position 38*a* and the second position 38*b*. The switching operation of the hydraulic switching valve 38 is performed by the direction switching valve 33 located on the upstream side from the hydraulic switching valve 38, the direction switching valve 33 being connected to the hydraulic switching valve 38.

As described above, according to the first hydraulic motor, when the direction switching valve 33 is operated to set to the first position 33*a*, the pilot fluid (the pilot oil) is released in the section between the direction switching valve 33 and the hydraulic switching valve 38, and thereby the hydraulic switching valve 38 is switched to the first position 38*a*. As the result, the swash plate switching cylinder 37 is shortened, and thereby the HST motor 36 is set to be in the first speed.

In addition, when the direction switching valve 33 is set to the second position 33*b* by operation of the switch, the pilot fluid is supplied to the hydraulic switching valve 38 through the direction switching valve 33, and thereby the hydraulic switching valve 38 is switched to the second position 38*b*. As the result, the swash plate switching cylinder 37 is stretched, and thereby the HST motor 36 is set to be in the second speed.

Meanwhile, the second traveling motor 31R also operates in the same manner as the first traveling motor 31L. Since the configuration and operation of the second traveling motor 31R are the same as those of the first traveling motor 31L, thus the description thereof will be omitted.

The hydraulic drive device 34 is a device configured to drive the first traveling motor 31L and the second traveling motor 31R, and includes a driving circuit (a left driving circuit) 34L for driving the first traveling motor 31L and a driving circuit (a right driving circuit) 34R for driving the second traveling motor 31R.

Each of the driving circuits 34L and 34R has an HST pump (a traveling pump) 53, a speed-changing fluid tube 100*h* and 100*i*, and a second charging fluid tube 100*j*. The speed-changing fluid tubes 100*h* and 100*i* are fluid passages connecting the HST pump 53 to the HST motor 36. The second charging fluid tube 100*j* is an oil passage connected to the speed-changing fluid tubes 100*h* and 100*i* and configured to charge the hydraulic fluid from the first hydraulic pump P1 to the speed-changing fluid tubes 100*h* and 100*i*.

The HST pump 53 is a variable capacity axial pump having a swash plate, the variable capacity axial pump being configured to be driven by the power of the prime mover 32. The HST pump 53 has a forward pressure-receiving portion 53*a* and a backward pressure-receiving portion 53*b* to which the pilot pressure is applied. The angle of the swash plate is changed by the pilot pressures applied to the pressure receiving portions 53*a* and 53*b*. When the angle of the swash plate is changed, it is possible to change the output (an output amount of the operation fluid) of the HST pump 53 and the output direction of the operation fluid.

The output of the HST pump 53 and the output direction of the operation fluid are changed by a traveling lever 54 disposed around the operator seat 8. The traveling lever 54 is supported so as to be tilted in a diagonal direction between the forward direction, the backward direction, the rightward direction, and the leftward direction from the neutral position. When the traveling lever 54 is tilted, each of the pilot valves 55 is operated by the tilting operation, the pilot valves 55 being provided at the lower part of the traveling lever 54.

When the traveling lever 54 is tilted forward, the forward pilot valve 55A is operated, and thus the pilot pressure is outputted from the forward pilot valve 55A. That pilot pressure is applied to the forward pressure-receiving portion 53*a* of the left driving circuit 34L and to the forward pressure-receiving portion 53*a* of the right driving circuit 34R. In this manner, the output shaft of the HST motor 36 rotates forward (forward rotation) at a speed proportional to the tilting amount of the traveling lever 54, and thus the working machine 1 travels straight forward.

In addition, when the traveling lever 54 is tilted backward, the backward traveling pilot valve 55B is operated to output the pilot pressure from the backward traveling pilot valve 55B. That pilot pressure is applied to the backward pressure-receiving portion 53*b* of the left driving circuit 34L and to the backward pressure-receiving portion 53*b* of the right driving circuit 34R. In this manner, the output shaft of the HST motor 36 rotates reversely (backward rotation) at a speed proportional to the tilting amount of the traveling lever 54, and the working machine 1 travels straight backward.

When the traveling lever 54 is tilted to the right side, the right turning pilot valve 55C is operated to output the pilot pressure from the right turning pilot valve 55C. That pilot pressure is also applied to the forward pressure-receiving portion 53*a* of the left driving circuit 34L and to the backward pressure-receiving portion 53*b* of the right driving circuit 34R. In this manner, the output shaft of the HST motor 36 on the left side rotates in the forward direction and the output shaft of the HST motor 36 on the right side rotates in the reverse direction, and thus the working machine 1 turns to the right.

In addition, when the travel lever 54 is tilted to the left side, the left turn pilot valve 55D is operated to output the pilot pressure from the left turn pilot valve 55D. That pilot pressure is also applied to the forward pressure-receiving portion 53*a* of the right driving circuit 34R and to the backward pressure-receiving portion 53*b* of the left driving circuit 34L. In this manner, the output shaft of the HST motor 36 on the right side rotates in the forward direction, and the output shaft of the HST motor 36 on the left side rotates in the reverse direction, and thus the working machine 1 turns to the left.

When the traveling lever 54 is tilted obliquely, the differential pressure of the pilot pressures applied to the forward pressure-receiving portion 53*a* and the backward pressure-receiving portion 53*b* of each driving circuit defines the rotational direction and the rotational speed of the output shaft of the HST motor 36, and thus the working machine 1 moves rightward or leftward while moving forward or backward.

The operating hydraulic system 30B will be described below.

As shown in FIG. 2, the operating hydraulic system 30B is a system configured to operate the boom 10, the bucket 11, the auxiliary attachment, and the like, and includes a second hydraulic pump P2 and a control valve unit (a valve control valve) 70.

The second hydraulic pump P2 is a pump configured to be driven by the power of the prime mover 32, and is constituted of a variable displacement pump installed at a position different from the position of the first hydraulic pump P1.

The control valve unit 70 controls an operating hydraulic actuators such as the boom cylinder 14, the bucket cylinder 15, and a hydraulic cylinder attached to an auxiliary attachment. The control valve unit 70 includes a pump port 71 and a tank port (output port) 72. A first supplying fluid tube 39*a* is connected to the pump port 71, the first supplying fluid tube 39*a* being connected to the second hydraulic pump P2.

As described below, the tank port (output port) 72 is connected by a fluid tube to the outputting portion through which the operation fluid is outputted. Here, the outputting portion is, for example, a suction port configured to suck the operation fluid of the hydraulic fluid tank 22 or of the hydraulic pumps (the first hydraulic pump P1 and the second hydraulic pump P2). In this embodiment, description will proceed on the assumption that the hydraulic fluid tank 22 serves as the outputting portion.

The control valve unit 70 has a plurality of control valves (flow control valves) 56. A second supplying fluid tube 39*b* is connected to the plurality of control valves 56, the second supplying fluid tube 39*b* being connected to the first supplying fluid tube 39*a*. In this manner, the hydraulic fluid outputted from the second hydraulic pump P2 is supplied to the plurality of control valves 56 through the first supplying fluid tube 39*a* and the second supplying fluid tube 39*b*.

That is, the first supplying fluid tube 39*a* and the second supplying fluid tube 39*b* constitute a supplying fluid tube 39. The supplying fluid tube 39 is configured to supply the hydraulic fluid to the plurality of control valves 56.

The plurality of control valves 56 include a boom control valve 56A, a bucket control valve 56B, and an auxiliary control valve 56C. The boom control valve 56A is a valve configured to control the boom cylinder 14, and the bucket control valve 56B is a valve configured to control the bucket cylinder 15.

Each of the boom control valve 56A and the bucket control valve 56B is a three-position switching valve having a direct-acting spool configured to be operated by the pilot pressure. The boom control valve 56A and the bucket control valve 56B are switched to the neutral position, the first position, and the second position by the pilot pressure.

A boom cylinder 14 is connected by a fluid tube to the boom control valve 56A, and a bucket cylinder 15 is connected by a fluid tube to the bucket control valve 56B.

The boom 10 and the bucket 11 are operated by the operation lever 58 arranged around the operator seat 8. The operation lever 58 is supported so as to be capable of tilting from a neutral position forward, backward, rightward, leftward, and toward the oblique directions. By tilting the operation lever 58, it is possible to operate each pilot valve provided to the lower portion of the operation lever 58.

When the operation lever 58 is tilted to the front side (forward), a downward-movement pilot valve 59A is operated to output the pilot pressure from the downward-movement pilot valve 59A. This pilot pressure is applied to the pressure-receiving portion of the boom control valve 56A, and thus the boom 10 moves downward (is swung downward).

When the operation lever 58 is tilted to the rear side (backward), the upward-movement pilot valve 59B is operated to output the pilot pressure from the upward-movement pilot valve 59B. This pilot pressure is applied to the pressure-receiving portion of the boom control valve 56A, and thus the boom 10 moves upward (is swung upward).

When the operation lever 58 is tilted to the right side (rightward), the pilot valve 59C for the bucket dumping is operated, and thus the pilot fluid is supplied to the pressure-receiving portion of the bucket control valve 56B. In this manner, the bucket control valve 56B is operated in a direction to stretch the bucket cylinder 15, and thus the bucket 11 performs the dumping operation at a speed proportional to the tilting amount (the tilting extent) of the operation lever 58.

When the operation lever 58 is tilted to the left side (leftward), the pilot valve 59D for the bucket shoveling is operated, and thus the pilot fluid is supplied to the pressure-receiving portion of the bucket control valve 56B. In this manner, the bucket control valve 56 B is operated in a direction to shorten the bucket cylinder 15, and thus the bucket 11 performs the shoveling operation at a speed proportional to the tilting amount (the tilting extent) of the operation lever 58.

A first supplying-outputting fluid tube 83*a* and a second supplying-outputting fluid tube 83*b* are connected to the auxiliary control valve 56C. The first supplying-outputting fluid tube 83*a* and the second fluid supplying-outputting fluid tube 83*b* are connected to the connecting member 50 to which the auxiliary hydraulic actuator of the auxiliary attachment is connected. Meanwhile, the auxiliary hydraulic actuator is constituted of a hydraulic cylinder, a hydraulic motor, a hydraulic pump, or the like.

The auxiliary control valve 56C is operated by the first solenoid valve 60A and the second solenoid valve 60B each of which sets a degree of opening aperture in accordance with the control device 88. In particular, an operation member 89 such as a switch is connected to the control device 88, and the degree of opening aperture of each of the first solenoid valve 60A and the second solenoid valve 60B is set based on the operation amount (the operation extent) of the operation member 89. As the result, the pilot pressure of either one of the first solenoid valve 60A and the second solenoid valve 60B is applied to the pressure-receiving portion of the auxiliary control valve 56C, and thus the auxiliary hydraulic attachment (auxiliary hydraulic actuator) is operated.

As shown in FIG. 2, the upstream side (one end side) of the second supplying fluid tube 39*b* is connected to the first supplying fluid tube 39*a*. The hydraulic fluid that is not supplied to the control valve 56 in the second supplying fluid tube 39*b* returns to the hydraulic fluid tank (the outputting portion) 22 through the drain fluid tube disposed on the downstream side of the second supplying fluid tube 39*b*.

In the second supplying fluid tube 39*b*, an output fluid tube 80 for outputting the operation fluid of the second supplying fluid tube 39*b* is connected to a partial section of the second supplying fluid tube 39*b* between the connecting portion connected to the pump port 71 and the connection portion to which the control valve 56 A on the most upstream side (the boom control valve 56 A) of the plurality of control valves 56. The output fluid tube 80 includes a main output fluid tube 80*a* and a sub-output fluid tube 80*b*.

The main output fluid tube 80*a* is a fluid tube to which a main relief valve 81 is connected. The sub-output fluid tube 80*b* is a fluid tube that is connected to the main output fluid tube 80*a* and outputs the returning fluid and the like in the plurality of control valves 56 (the boom control valve 56A, the bucket control valve 56B, the auxiliary control valve 56C).

The sub-output fluid tube 80*b* is connected to the tank port 72 by the second supplying fluid tube 39*b*. The hydraulic fluid outputted from the main relief valve 81 and the returning fluid passing through the plurality of control valves 56 are outputted to the hydraulic fluid tank 22 through the output fluid tube 80 and the tank port 72.

In the hydraulic system of the working machine 1, it is possible to output the operation fluid outputted from the operating hydraulic device and the operation fluid outputted from the traveling hydraulic device to the fluid cooler 82. In this embodiment, the operating hydraulic device is constituted of a control valve unit 70, and the traveling hydraulic device is constituted of the traveling motor 36.

The following description will explain below the fluid tube relating to the outputting of the operation fluid and the outputting of the operation fluid in detail.

The operating hydraulic device (control valve unit) 70 and the operation fluid tank 22 are connected each other by a first output fluid path 91. The first output fluid tube 91 connects the tank port 72 to the hydraulic fluid tank 22. The first output fluid tube 91 is connected to a second output fluid tube 92. The second output fluid tube 92 is branched from the first output fluid tube 91 and is connected to an input port 82*a* of the fluid cooler 82.

In addition, the first output fluid tube 91 is provided with a branching portion 110 at which the second output fluid tube 92 branches from the first output fluid tube 91. And, the first output fluid tube 91 is provided with a second check valve (a second non-return valve) 102 in a section 91*a* between the hydraulic fluid tank 22 and the branching portion 110.

The second check valve 102 is a valve configured to allow the hydraulic fluid to flow toward the hydraulic fluid tank 22 and to prevent the hydraulic fluid from flowing toward the branching portion 110. The second check valve 102 has a first setting member 102 a configured to set a differential pressure. The first setting member 102*a* is constituted of a spring or the like, and the first setting member 102*a* presses the valve body of the second check valve 102 with a predetermined biasing force from the side opposite to the direction allowing the flow of the hydraulic fluid (from the side in the direction preventing the flow of the hydraulic fluid), thereby generating the differential pressure.

Additionally, in the first output fluid tube 91, a fourth check valve (a fourth non-return valve) 104 is connected to a section 91*b* between the tank port 72 and the branching portion 110. The fourth check valve 104 allows the hydraulic fluid to flow toward the second output fluid tube 92 (toward the branching portion 110) and prevents the hydraulic fluid from flowing toward the operating hydraulic device (toward the tank port 72).

In addition, a third output fluid tube 93 is connected to an output port 82*b* different from the input port 82*a* of the fluid cooler 82. The third output fluid tube 93 connects the output port 82*b* to the hydraulic fluid tank 22. That is, the third output fluid tube 93 is a fluid tube (an fluid passage) through which the hydraulic fluid cooled by the fluid cooler 82 flows to the outputting portion, for example, to the hydraulic fluid tank 22.

As shown in FIG. 1, a fourth output fluid tube 94 is connected to the traveling motor 36. As shown in FIG. 1 and FIG. 2, one end side of the fourth output fluid tube 94 is connected to an output port of the traveling motor 36, and the other end side of the fourth output fluid tube 94 is connected to the second output fluid tube 92 (is connected to the second output fluid tube 92). A first check valve (a first non-return valve) 101 is disposed on an intermediate portion of the fourth output fluid tube 94.

The first check valve 101 is constituted of a valve configured to allow the hydraulic fluid to flow toward the second output fluid tube 92 (that is, the fluid cooler 82), and to prevent the hydraulic fluid from flowing from the output fluid tube 92 side toward the fourth output fluid tube 94. The first check valve 101 is, for example, constituted of a check valve, a relief valve configured to flow the hydraulic fluid in one direction, or the like.

Additionally, in the fourth output fluid tube 94, a fifth output fluid tube 95 is connected to a section 94*a* between the first check valve 101 and the traveling motor. The fifth output fluid line 95 is connected to the hydraulic fluid tank 22. A third check valve (a third non-return valve) 103 is disposed on an intermediate portion of the fifth output fluid line 95.

The third check valve 103 is constituted of a valve configured to permit the hydraulic fluid to flow toward the hydraulic fluid tank 22 and to prevent the hydraulic fluid from flowing toward the section 94*a* of the fourth output fluid tube 94. The third check valve 103 has a second setting member 103*a* configured to set a differential pressure. The second setting member 103*a* is constituted of a spring or the like, and the second setting member 103*a* presses the valve body of the third check valve 103 with a predetermined biasing force from the side opposite to the direction allowing the flow of the hydraulic fluid (from the side in the direction preventing the flow of the hydraulic fluid), thereby generating the differential pressure.

Here, in comparison between the differential pressure (referred to as a first differential pressure) of the first setting member 102*a* in the second check valve 102 and the differential pressure (referred to as a second differential pressure) of the second setting member in the third check valve 103, the first differential pressure is set to be larger than the second differential pressure.

As described above, the hydraulic system for the working machine includes the first output fluid tube 91, the second output fluid tube branched from the first output fluid tube and connected to the fluid cooler 82, the fourth output fluid tube 94, and the first check valve 101. In this manner, the hydraulic fluid outputted from the operating hydraulic device passes through the fluid cooler 82, and thereby the hydraulic fluid is cooled. And, the hydraulic fluid outputted from the traveling hydraulic device also passes through the fluid cooler 82, and thereby the hydraulic fluid is cooled. The operation fluid outputted from the operating hydraulic device and the operation fluid outputted from the operating hydraulic device are selectively outputted.

For example, the first check valve 101 is disposed on the fourth output fluid tube 94. In this manner, when the pressure of the hydraulic fluid outputted from the operating hydraulic device is low, the hydraulic fluid outputted from the traveling hydraulic device is outputted to the fluid cooler 82, and when the pressure of the hydraulic fluid outputted from the operating hydraulic device is high, the hydraulic fluid outputted from the traveling hydraulic device is outputted to the fluid cooler 82. In addition to that, the hydraulic fluid outputted from the operating hydraulic device is prevented from flowing into the traveling hydraulic device side. In addition, when the second check valve 102 is provided, the operation fluid in the operating hydraulic device is outputted to the operation fluid tank 22 and the like through the second check valve 102*s* without passing through the fluid cooler 82.

In addition, the fifth output fluid tube 95 branching from the fourth output fluid tube 94 and connected to the hydraulic fluid tank 22 is provided, and the fifth output fluid tube 95 is provided with the third check valve 103. Thus, when hydraulic fluid is outputted from both of the operating hydraulic device and the traveling hydraulic device, the operation fluid in the traveling hydraulic device is outputted through the fifth output fluid tube 95 and the third check valve 103.

In addition, the second check valve 102 is provided with the first setting member 102*a*, and the third check valve is provided with the second setting member 103*a*. Thus, it is possible to arbitrarily set how to flow the hydraulic fluid outputted from the operating hydraulic device and the hydraulic fluid outputted from the traveling hydraulic device. In this manner, the hydraulic fluid outputted from the operating hydraulic device is outputted certainly from the traveling hydraulic device.

For example, the hydraulic fluid outputted from the traveling hydraulic device is certainly prevented from flowing to the operating hydraulic device under a state where the operating hydraulic device is not in operation.

Second Embodiment

Figure 3:
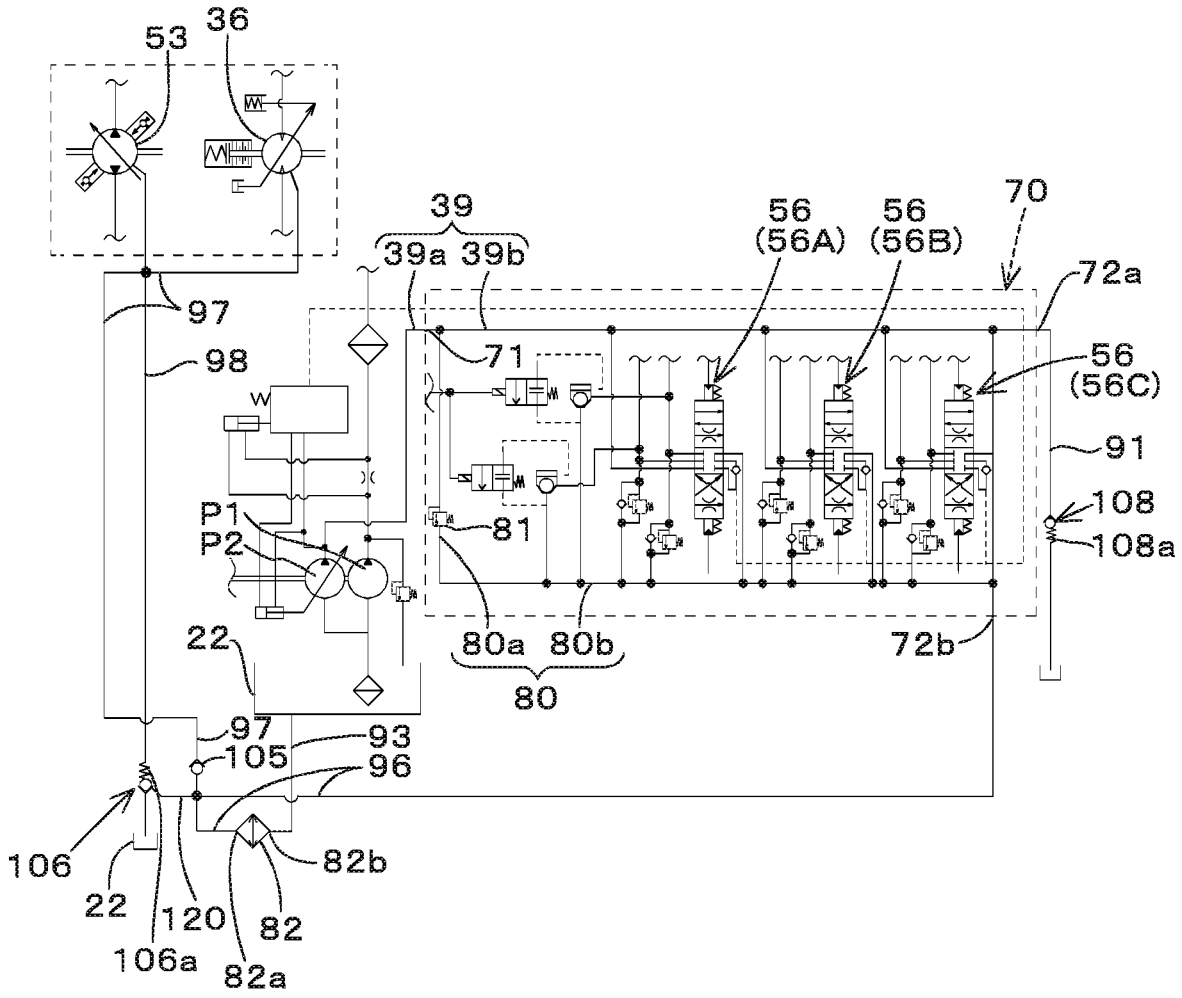
FIG. 3 is a schematic view illustrating a hydraulic system for a working machine according to a second embodiment of the present invention.

FIG. 3 shows a hydraulic system for a working machine according to a second embodiment of the present invention. In the second embodiment, a configuration different from the configuration of the first embodiment will be described below. In the second embodiment, the operating hydraulic device is constituted of the control valve unit 70, and the traveling hydraulic device is constituted of the traveling motor 36 and the traveling pump 53.

As shown in FIG. 3, the control valve unit 70 has a plurality of ports configured to discharge the hydraulic fluid. In particular, the tank port 72 in the control valve unit 70 includes a first tank port (a first output port) 72*a* and a second tank port (a second output port) 72*b*. One end side of the second supplying fluid tube 39*b* is connected to the pump port 71, and the other end side of the second supplying fluid tube 39*b* is connected to the first tank port 72*a*. The first output fluid tube 91 is connected to the first tank port 72*a*. An eighth check valve (an eighth non-return valve) 108 is disposed on an intermediate portion of the first output fluid tube 91.

The eighth check valve 108 is constituted of a valve configured to allow the hydraulic fluid to flow toward the hydraulic fluid tank 22 and to prevent the hydraulic fluid from flowing toward the control valve unit 70 (the first tank port 72*a*). The eighth check valve 108 has a setting member (a third setting member) 108*a* configured to set a differential pressure. The third setting member 108*a* is constituted of a spring or the like, and the third setting member 108*a* presses the valve body of the eighth check valve 108 with a predetermined biasing force from the side opposite to the direction allowing the flow of the hydraulic fluid (from the side in the direction preventing the flow of the hydraulic fluid), thereby generating the differential pressure.

In addition, the sub-output fluid tube 80*b* is connected to the second tank port 72*b*. The second tank port 72*b* and the input port 82*a* of the fluid cooler 82 are connected each other by a sixth output fluid tube 96. A seventh output fluid tube 97 is connected to the sixth output fluid tube 96, the seventh output fluid tube 97 being connected to the sixth output fluid tube 96. The seventh output fluid tube 97 is connected to the output ports of the traveling motor 36 and the traveling pump 53. A fifth check valve (a fifth non-return valve) 105 is disposed on the seventh output fluid tube 97. The fifth check valve 105 is constituted of a valve configured to allow the hydraulic fluid to flow toward the fluid cooler 82 and to prevent the hydraulic fluid from flowing toward the traveling motor 36 and the traveling pump 53.

An eighth output fluid tube 98 connected to the hydraulic fluid tank 22 is connected to the seventh output fluid tube 97. A sixth check valve (a sixth non-return valve) 106 is connected to the eighth output fluid tube 98. The sixth check valve 106 is constituted of a pilot check valve, and has a pressure-receiving portion 106*a* configured to receive a pressure of the operation fluid. The pressure-receiving portion 106*a* of the sixth check valve 106 is connected to the sixth output fluid tube 96 by the pilot fluid tube 120. The sixth check valve 106 is configured to allow the operation fluid in the eighth output fluid tube 98 to be outputted when the pressure of the hydraulic fluid applied to the pressure-receiving portion 106*a* is equal to or higher than a predetermined pressure, and to prevent the operation fluid in the eighth output fluid tube 98 from being outputted when the hydraulic fluid is not applied to the pressure-receiving portion 106*a*.

Figure 4:
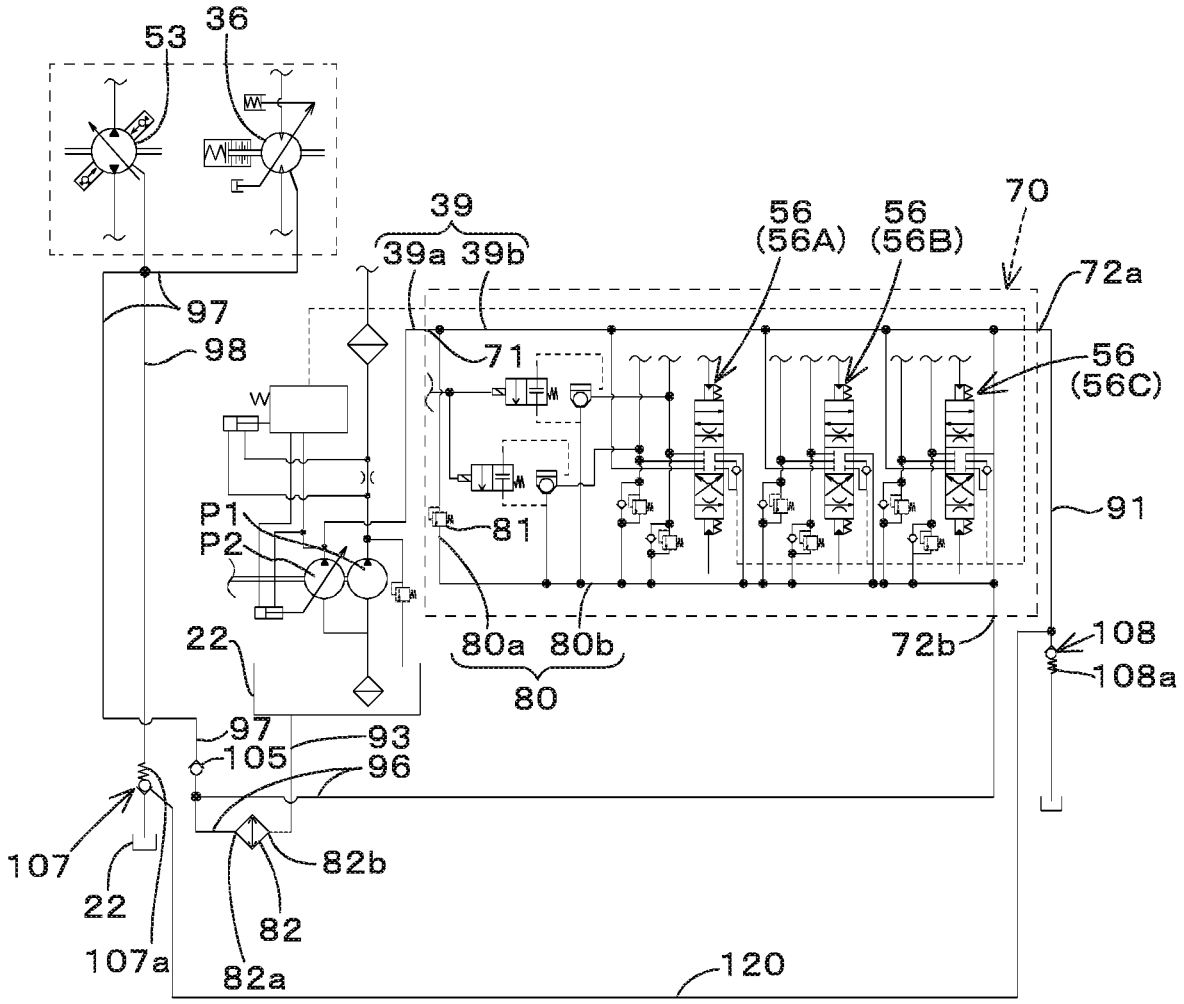
FIG. 4 is a view illustrating a modified example of the hydraulic system for the working machine according to the second embodiment.

FIG. 4 shows a modified example of the hydraulic system for the working machine according to the second embodiment. As shown in FIG. 4, a seventh check valve (a seventh non-return valve) 107 is connected to the eighth output fluid tube 98. The seventh check valve 107 is constituted of a pilot check valve, and has a pressure-receiving portion 107*a* configured to receive a pressure of the operation fluid. The pressure-receiving portion 107*a* of the seventh check valve 107 is connected to the first output fluid tube 91 by the pilot fluid tube 120. The seventh check valve 107 is configured to allow the operation fluid in the eighth output fluid tube 98 to be outputted when the pressure of the operation fluid applied to the pressure-receiving portion 107*a* is equal to or higher than a predetermined pressure and to prevent the operation fluid in the eighth output fluid tube 98 from being outputted when the pressure of the operation fluid is not applied to the pressure-receiving portion 107*a*.

As described above, the hydraulic system for the working machine includes the first output fluid tube 91, the sixth output fluid tube 96, the seventh output fluid tube 97, the eighth output fluid tube 98, the fifth check valve 105, and a sixth check valve (a sixth non-return valve) 106. In this manner, the hydraulic fluid in the operating hydraulic device is outputted through the first output fluid tube 91 and the sixth output fluid tube 96, and the hydraulic fluid is cooled by the fluid cooler 82 connected to the sixth output fluid tube 96. In addition, the operation fluid in the traveling hydraulic device can is outputted through the seventh discharge oil path 97.

Here, since the sixth check valve 106 is disposed on the eighth output fluid tube 98, the operation fluid outputted from the traveling hydraulic device is directly outputted not to the fluid cooler 82 but to the hydraulic fluid tank 22 when the hydraulic fluid is outputted from the operating hydraulic device. That is, it is possible to supply the hydraulic fluid outputted from the operating hydraulic device to the fluid cooler 82 in preference to the hydraulic fluid outputted from the traveling hydraulic device.

Since the eighth check valve 108 is disposed on the first output fluid tube 91, the operation fluid to be outputted from the first output fluid tube 91, among the first output fluid tube 91 and the sixth output fluid tube 96 each configured to output the hydraulic fluid in the operating hydraulic device 91, is outputted without passing through the fluid cooler 82.

Third Embodiment

Figure 5:
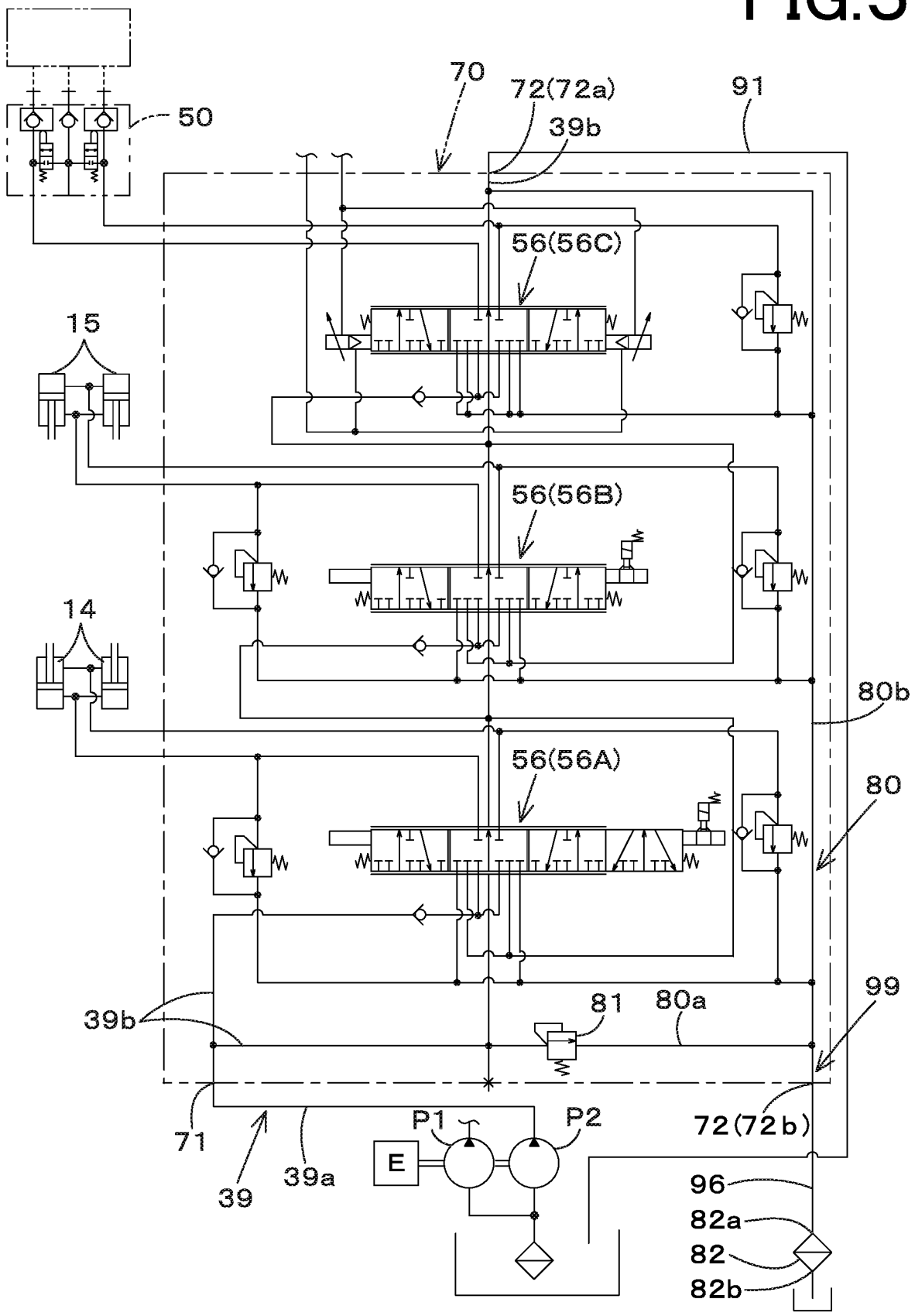
FIG. 5 is a schematic view illustrating a hydraulic system for a working machine according to a third embodiment of the present invention.

FIG. 5 shows the hydraulic system for the working machine according to a third embodiment of the present invention. In the third embodiment, a configuration different from the configurations of the above-described embodiments will be described below. In the third embodiment, the control valve unit 70 employs an open center circuit, and other configurations relating to the control valve are substantially the same.

As shown in FIG. 5, one end side of the sub-output fluid tube 80*b* is connected to the most downstream side of the second supplying fluid tube 39, and the other end portion of the sub-output fluid tube 80*b* is connected to the main output fluid tube 80*a*. In addition, the main output fluid tube 80*a* is connected not only to the sub-output fluid tube 80*b* but also to the second tank port 72*b*. The sixth output fluid tube 96 is connected to the second tank port 72*b*, and the fluid cooler 82 is connected to the sixth output fluid tube 96.

Thus, in the third embodiment, the main output fluid tube 80*a*, the sub-output fluid tube 80*b*, and the sixth discharge oil path 96 are connected each other, and thereby a ninth output fluid tube 99 is configured to supply, to the fluid cooler 82, the operation fluid outputted from the main relief valve 81 and the returning fluid from the control valve 56.

As described above, the hydraulic system for the working machine includes the supplying fluid tube 36, the first output fluid tube 91, the ninth output fluid tube 99 connected to the supplying fluid tube 36 separately from the first output fluid tube 91, configured to supply the returning fluid from the control valve 56, and connected to the fluid cooler 82, and the main relief valve 81 disposed on the ninth output fluid tube 99.

Thus, the hydraulic fluid that is not supplied from the hydraulic pump to the control valve 56 is outputted through the first output fluid tube 91. On the other hand, the returning operation fluid or the hydraulic fluid from the main relief valve 81 is outputted to the fluid cooler 82 to be cooled, after being supplied to the control valve 56.

Figure 6A:
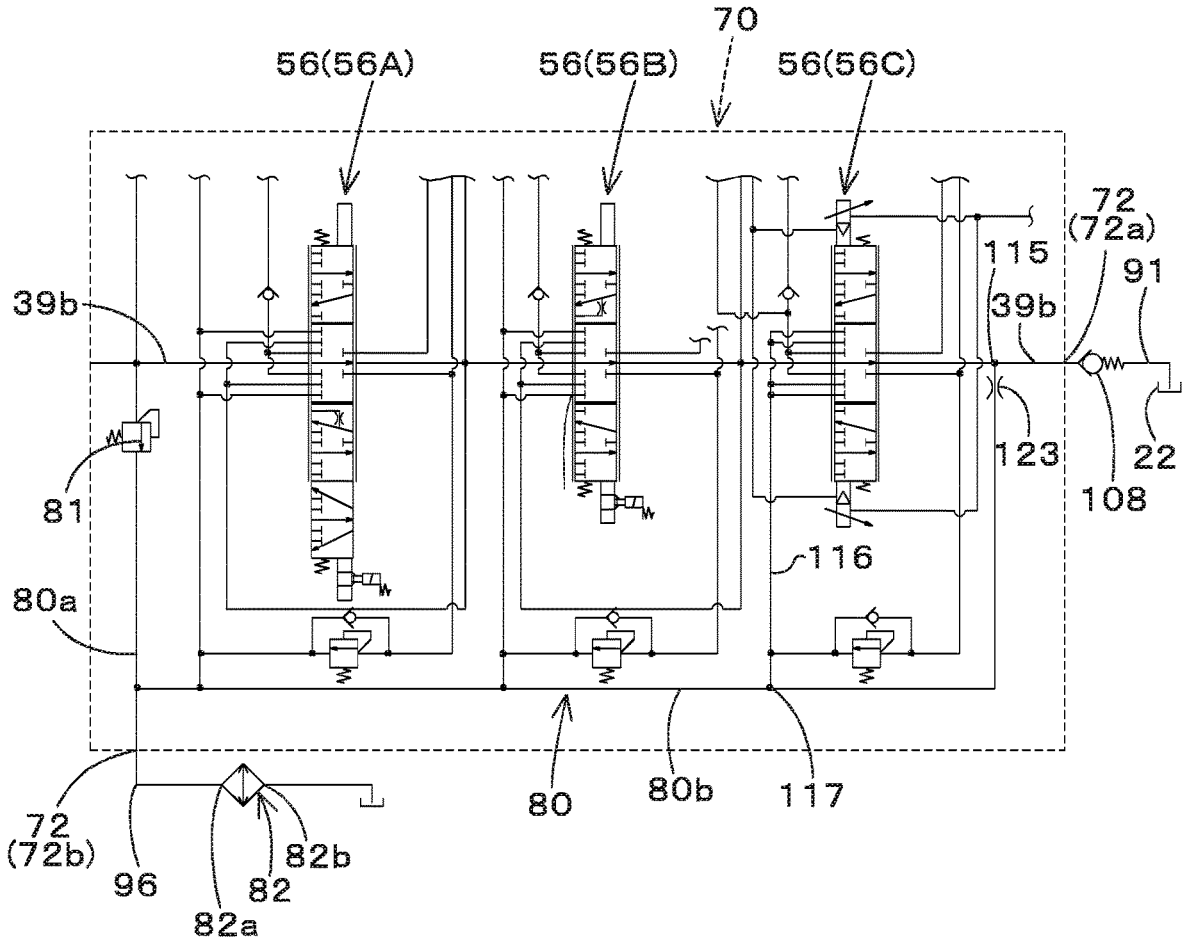
FIG. 6A is a view illustrating a first modified example of the hydraulic system for the working machine according to the third embodiment.
Figure 6B:
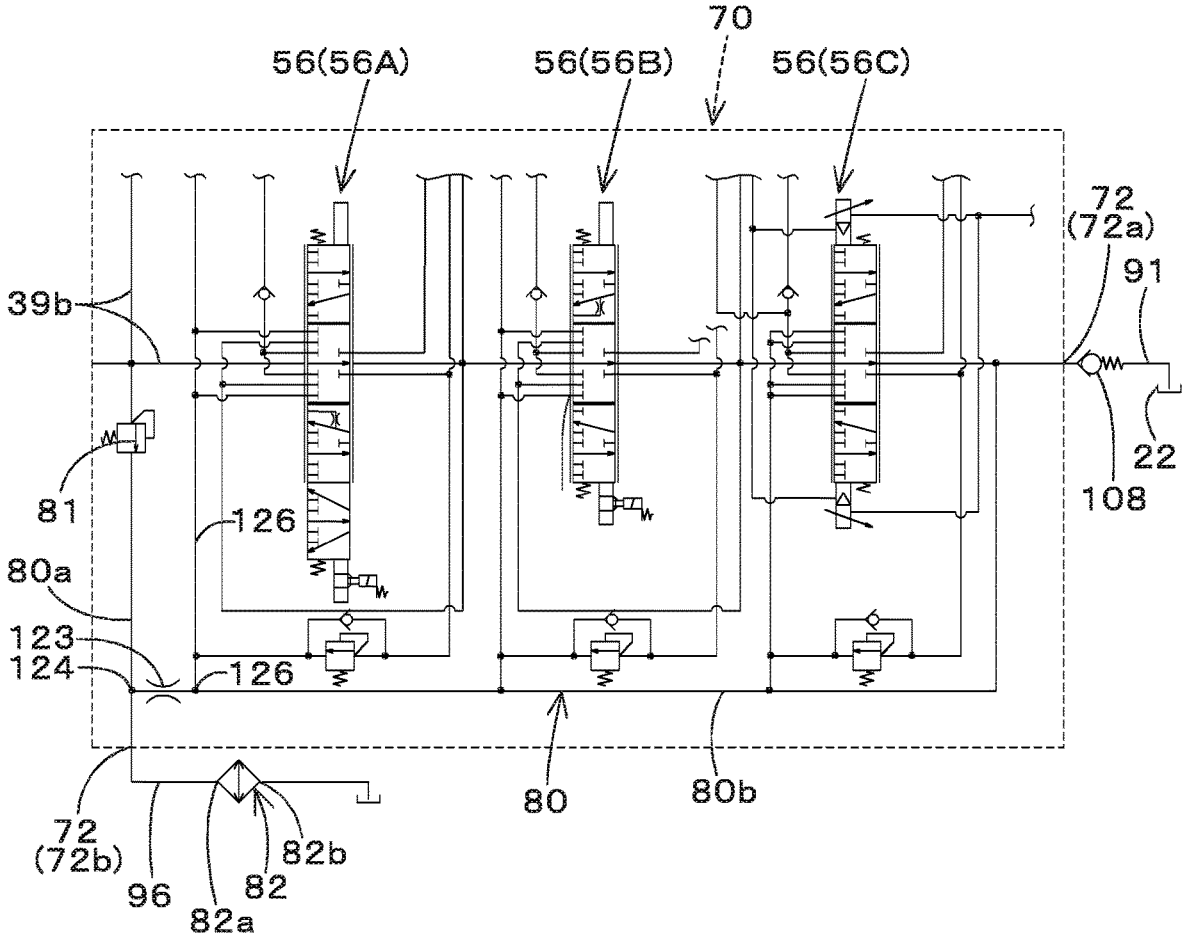
FIG. 6B is a view illustrating a second modified example of the hydraulic system for the working machine according to the third embodiment.
Figure 6C:
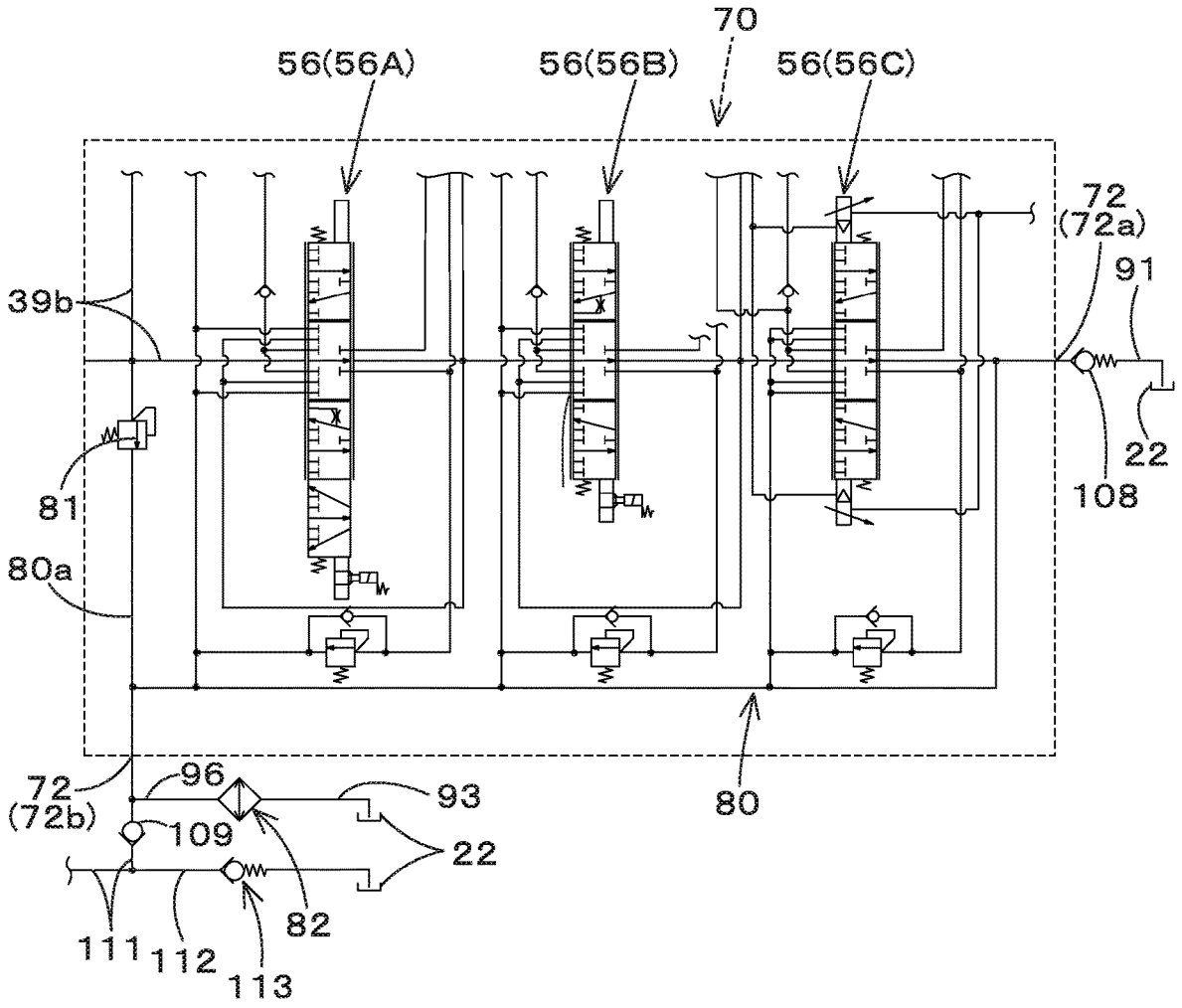
FIG. 6C is a view illustrating a third modified example of the hydraulic system for the working machine according to the third embodiment.

FIG. 6A to FIG. 6C show a modified example of the hydraulic system for the working machine according to the third embodiment.

FIG. 6A and FIG. 6B show a hydraulic system including a throttle portion (a throttle) 123. The throttle portion 123 is disposed on the sub-output fluid tube 80*b*.

As shown in FIG. 6A, the throttle portion 123 is arranged in the vicinity of the connecting portion 115 that connects the sub-output fluid tube 80*b* and the second supplying fluid tube 39*b* each other. More specifically, in the sub-output fluid tube 80*b*, the throttle portion 123 is disposed between the connecting portion 117 at which the output fluid tube 116 of the third control valve 56C arranged at the most downstream side of the plurality of control valves 56 is connected to the sub-output fluid tube 80*b* and the connecting portion 115.

In the modified example of FIG. 6A, the throttle portion 123 is arranged between the connecting portion 117 and the connecting portion 115 in the ninth output fluid tube 99 (the main output fluid tube 80*a*, the sub-output fluid tube 80*b*, and the sixth output fluid tube 96). Thus, the throttle portion 123 arranged between the connecting portion 117 and the connecting portion 115 allows the operation fluid returning from the auxiliary attachment to the third control valve 56C to be outputted preferentially to the fluid cooler 82 side. Meanwhile, instead of the provision of the throttle portion 123, the fluid tube provided in the section extending between the connecting portion 117 and the connecting portion 115 may be omitted.

As shown in FIG. 6B, the throttle portion 123 is arranged in the vicinity of the connecting portion 124 that connects the main output fluid tube 80*b* and the sub-output fluid tube 80*b* each other. More specifically, in the sub-output fluid tube 80*b*, the throttle portion 123 is disposed between the connecting portion 126 at which the output fluid tube 125 of the first control valve 56A arranged at the most upstream side of the plurality of control valves 56 is connected to the sub-output fluid tube 80*b* and the connecting portion 124.

In the modified example shown in FIG. 6B, the throttle portion 123 is provided between the connecting portion 126 and the connecting portion 124, and thereby the hydraulic fluid outputted from the main relief valve 81 is outputted to the fluid cooler 82 in preference to the hydraulic fluid returning to the control valve 57. Meanwhile, instead of the provision of the throttle portion 123, the fluid tube provided in the section extending between the connecting portion 126 and the connecting portion 124 may be omitted.

As shown in FIG. 6C, a tenth output fluid tube 111 connected to the traveling hydraulic device such as the traveling motor is connected to the sixth output fluid tube 96. That is, the fourth output fluid tube 94 is connected to the second output fluid tube 92 connected to the fluid cooler 82, whereas the tenth output fluid tube 111 shown in FIG. 6C is connected to the sixth output fluid tube 96 connected to the fluid cooler 82. And, the tenth output fluid tube 111 is a fluid tube having a different connecting destination with respect to the fourth output fluid tube 94, and the other configurations are the same as the configurations of the fourth output fluid tube 94.

That is, an eleventh output fluid tube 112 corresponding to the fifth output fluid tube 95 connected to the fourth output fluid tube 94 is connected to the tenth output fluid tube 111, and the ninth check valve 109 corresponding to the first check valve 101 is connected to the tenth output fluid tube 111. In addition, a tenth check valve (a tenth non-return valve) 113 corresponding to the third check valve 103 connected to the fifth output fluid tube 95 is disposed on the eleventh output fluid tube 112.

In the modified example of FIG. 6C, the hydraulic fluid outputted from the first output port 72*a* of the operating hydraulic device is outputted to the hydraulic fluid tank 22 and the like, and additionally the operation fluid outputted from the second output port 72*b* of the operating hydraulic device is supplied to the fluid cooler 82. In addition to that, the hydraulic fluid outputted from the traveling hydraulic device is also supplied to the fluid cooler 82 through the tenth output fluid tube 111 and the sixth output fluid tube 96.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

The number of tank ports 72 in the control valve unit 70, the operating hydraulic device, and the traveling hydraulic device are not limited to those described above. In the above-described embodiments, the outputting portions of the hydraulic fluid tank 22 and the like are the structures to output the hydraulic fluid, but the outputting portion is just required to have a structure to output the operation fluid cooled by the fluid cooler 82. In addition, the non-return valve according to the above-described embodiments often employs a check valve for example, but the non-return valve may be a relief valve or the like configured to allow the hydraulic fluid to flow in one direction.

Obviously, numerous modifications and variations of the present invention are possible in light of the above teachings. It is therefore to be understood that within the scope of the appended claims, the invention may be practiced otherwise than as specifically described herein.

What is claimed is:

1. A hydraulic system for a working machine, comprising:

a fluid cooler including an input port and an output port, the fluid cooler being configured to cool an operation fluid;

an outputting portion to output the operation fluid;

a traveling hydraulic device to be activated by the operation fluid;

an operating hydraulic device to be activated by the operation fluid;

a first output fluid tube connecting the operating hydraulic device to the outputting portion;

a second output fluid tube branching from the first output fluid tube and being connected to the input port of the fluid cooler;

a third output fluid tube connecting the outputting portion to the output port of the fluid cooler:

a fourth output fluid tube connected to the traveling hydraulic device, the fourth output fluid tube being connected to the second output fluid tube;

a first check valve disposed on the fourth output fluid tube, the first check valve being configured to allow the operation fluid to flow toward the fluid cooler and to block the operation fluid flow from the fluid cooler; and a second check valve disposed on the first output fluid tube between the outputting portion and a branching portion at which the second output fluid tube is branched, the second check valve being configured to allow the operation fluid to flow toward the outputting portion and to block the operation fluid flow toward the branching portion.

2. The hydraulic system for the working machine according to claim 1, comprising:

a fifth output fluid tube branching from the fourth output fluid tube and being connected to the outputting portion; and a third check valve disposed on the fifth output fluid tube, the third check valve being configured to allow the operation fluid to flow toward the outputting portion and to block the operation fluid flow toward the fourth output fluid tube.

3. The hydraulic system for the working machine according to claim 2, wherein the second check valve includes a first setting member to set a pressure difference, and wherein the third check valve includes a second setting member to set another pressure difference.

4. The hydraulic system for the working machine according to claim 3, wherein the pressure difference in the first setting member is larger than the other pressure difference in the second setting member.

5. The hydraulic system for the working machine according to claim 1, comprising a fourth check valve disposed on the first output fluid tube, the fourth check valve being configured to allow the operation fluid to flow toward the second output fluid tube and to block the operation fluid flow toward the operating hydraulic device.

6. A hydraulic system for a working machine, comprising:

an fluid cooler to cool an operation fluid;

an outputting portion to output the operation fluid;

a traveling hydraulic device to be activated by the operation fluid;

an operating hydraulic device including a first output port and a second output port;

a first output fluid tube connecting the outputting portion to the first output port of the operating hydraulic device;

a sixth output fluid tube connected to the second output port of the operating hydraulic device and to the fluid cooler;

a third output fluid tube connecting the outputting portion to the fluid cooler;

a seventh output fluid tube connected to the traveling hydraulic device, the seventh output fluid tube being connected to the sixth output fluid tube;

a fifth check valve disposed on the seventh output fluid tube, the fifth check valve being configured to allow the operation fluid to flow toward the fluid cooler and to block the operation fluid flow toward the traveling hydraulic device;

an eighth output fluid tube connected to the outputting portion, the eighth output fluid tube being connected to the seventh output fluid tube; and a sixth check valve including a receiving portion to receive a pressure of the operation fluid of the sixth output fluid tube, the sixth check valve being configured to allow the operation fluid in the eighth output fluid tube to be outputted when the pressure of the operation fluid applied to the receiving portion is a predetermined pressure or more and to block the operation fluid in the eighth output fluid tube from being outputted when the pressure of the operation fluid is not applied to the receiving portion.

7. The hydraulic system for the working machine according to claim 6, comprising an eighth check valve disposed on the first output fluid tube, the eighth check valve being configured to allow the operation fluid to flow toward the outputting portion and to block the operation fluid flow toward the operating hydraulic device.

8. The hydraulic system for the working machine according to claim 7, wherein the eighth check valve includes a third setting member to set a pressure difference.

9. A hydraulic system for a working machine, comprising:

an fluid cooler to cool an operation fluid;

an outputting portion to output the operation fluid;

a traveling hydraulic device to be activated by the operation fluid;

an operating hydraulic device including a first output port and a second output port, the first output port and the second output port each being configured to output the operation fluid;

a first output fluid tube connecting the outputting portion to the first output port of the operating hydraulic device;

a sixth output fluid tube connected to the second output port of the operating hydraulic device and to the fluid cooler;

a third output fluid tube connecting the outputting portion to the fluid cooler;

a seventh output fluid tube connected to the traveling hydraulic device, the seventh output fluid tube being connected to the sixth output fluid tube;

a fifth check valve disposed on the seventh output fluid tube, the fifth check valve being configured to allow the operation fluid to flow toward the fluid cooler and to block the operation fluid flow toward the traveling hydraulic device;

an eighth output fluid tube connected to the outputting portion, the eighth output fluid tube being connected to the seventh output fluid tube; and a seventh check valve including a receiving portion to receive a pressure of the operation fluid of the first output fluid tube, the seventh check valve being configured to allow the operation fluid in the eighth output fluid tube to be outputted when the pressure of the operation fluid applied to the receiving portion is a predetermined pressure or more and to block the operation fluid in the eighth output fluid tube from being outputted when the pressure of the operation fluid is not applied to the receiving portion.

10. A hydraulic system for a working machine, comprising:

an fluid cooler to cool an operation fluid;

an outputting portion to output the operation fluid;

a hydraulic pump to output the operation fluid;

a plurality of hydraulic devices activated by the operation fluid;

a plurality of control valves to control the plurality of hydraulic devices;

a supplying fluid tube connected to the hydraulic pump, the supplying fluid tube being configured to supply the operation fluid to the plurality of control valves;

a first output fluid tube connecting the supplying fluid tube to the outputting portion;

a ninth output fluid tube connected to the supplying fluid tube and connected to the fluid cooler; and a main relief valve disposed on the ninth output fluid tube;

wherein the ninth output fluid tube includes a main output fluid tube to which the main relief valve is connected;

a sub-output fluid tube connected to the main output fluid tube, the sub-output fluid tube being configured to supply the operation fluid returning from the control valves; and a throttle disposed on the sub-output fluid tube.

11. A hydraulic system for a working machine, comprising:

an fluid cooler to cool an operation fluid;

an outputting portion to output the operation fluid;

a traveling hydraulic device to be activated by the operation fluid;

an operating hydraulic device including a first output port and a second output port;

a first output fluid tube connecting the outputting portion to the first output port of the operating hydraulic device;

a sixth output fluid tube connected to the second output port of the operating hydraulic device and to the fluid cooler;

a tenth output fluid tube connected to the traveling hydraulic device, the tenth output fluid tube being connected to the sixth output fluid tube;

a third output fluid tube connecting the outputting portion to the fluid cooler;

a ninth check valve disposed on the tenth output fluid tube, the ninth check valve being configured to allow the operation fluid to flow toward the fluid cooler and to block the operation fluid flow toward the tenth output fluid tube.

* * * * *